US005442938A

United States Patent [19]

Kislyuk

[11] Patent Number: 5,442,938

[45] Date of Patent: Aug. 22, 1995

[54] ACCESSORY KIT FOR CONVERTING A HOME DRYER TO A DRY CLEANING MACHINE

[76] Inventor: Mark N. Kislyuk, 619 N. Lawn Dr., Youngstown, Ohio 44505

[21] Appl. No.: 12,633

[22] Filed: Feb. 3, 1993

[51] Int. Cl.[6] ..... D06F 39/04

[52] U.S. Cl. ..... 68/5 C; 68/20; 34/91; 34/389

[58] Field of Search ..... 68/5 C, 5 D, 5 E, 20; 8/149.2; 34/90, 91, 243 R

[56] References Cited

U.S. PATENT DOCUMENTS

| | | | |
|---|---|---|---|
| 1,902,575 | 3/1933 | Nichols . | |
| 2,139,495 | 3/1940 | Rolkern . | |
| 2,438,995 | 4/1948 | Forney . | |
| 2,555,268 | 5/1951 | Chamberlin . | |
| 2,608,003 | 8/1952 | Tucker . | |
| 2,708,230 | 5/1955 | Bowman . | |
| 3,516,174 | 6/1970 | Behrens . | |
| 3,531,754 | 10/1970 | Krupsfy | 68/18 F |
| 4,336,024 | 6/1982 | Dennissenko et al. . | |
| 4,850,117 | 6/1987 | Fuhring | 68/18 F |
| 5,046,337 | 9/1991 | Ro | 68/18 F |

*Primary Examiner*—Frankie L. Stinson
*Attorney, Agent, or Firm*—Browdey and Neimark

[57] ABSTRACT

An accessory kit for converting a home dryer into a dry cleaning machine. The dryer has a rotatable drum enclosed in a dryer housing sealable by a door. The dryer housing has a ventilation system vented to an atmosphere and associated electro-mechanical means for actuating rotation of said drum and said ventilation system. The accessory kit includes: cleaning fluid dispenser apparatus engaged to the dryer which includes spray dispensor which sprays a predetermined amount of cleaning fluid vapor into the dryer drum and also actuates both rotation of the drum and the ventilation system for predetermined periods of time, and filter apparatus engaged in an outlet of the dryer ventilation system for separating soil from a mixture of air and soiled cleaning fluid vapor vented from the dryer housing and thereafter precipitating remaining cleaning fluid vapor from air during exhaustion of air through the filter.

10 Claims, 4 Drawing Sheets

ACCESSORY KIT FOR CONVERTING A HOME DRYER TO A DRY CLEANING MACHINE

FIELD OF THE INVENTION

This invention is an accessory kit for use with commercially sold home clothes dryers. More particularly, the invention is directed to an accessory kit which selectively converts such clothes dryers to a dry cleaning machine and back to a conventional dryer when the user so desires.

BACKGROUND OF THE INVENTION

Conventional home clothes dryers presently have the single utility of drying clothes after they have been washed. However, such clothes dryers all have a rotatable drum enclosed in a sealable housing, a ventilation system and associated electro-mechanical components for actuating the drum and ventilating system, similar to that of commercial dry cleaning machines. This combination of components has not been previously used to effectively create a dual use machine capable of, when desired, drying clothes which have been washed in soap and water or, when desired, dry cleaning clothes which cannot be so washed.

This is due to the failure to develop additional necessary components in an accessory kit for conventional clothes dryers which would enable their conversion to a dry cleaning machine. In the absence of such accessory apparatus consumers are only able to clean clothes in their home which can be washed in soap and water while clothes requiring dry cleaning must be taken to a business establishment directed to that purpose. This, of course, is inconvenient and leads to a disincentive to purchasing clothes which can only be dry cleaned.

OBJECTIVE OF THE INVENTION

In order to overcome the above identified problems, it is a primary objective of this invention to provide an accessory kit for use with a conventional home clothes dryer which enables its owner to selectively use such dryer as a dry cleaning machine.

It is a further objective of this invention to provide an accessory kit that can be simply installed in a conventional home clothes dryer to convert such dryer to a dry cleaning machine.

It is still another objective of this invention to provide an accessory kit installable in a conventional home clothes dryer which includes a dry cleaning fluid "dispenser" necessary to convert such dryer to a dry cleaning machine and a filter which prevents the fumes or vapor from such fluid venting to the atmosphere.

SUMMARY OF THE INVENTION

The accessory kit for converting the home clothes dryer to a dry cleaning machine comprises a two part kit to be engaged with any commercially sold home clothes dryer. The kit includes a cleaning fluid dispenser which is engaged to the inside surface of the dryer access door and to the dryer electrical system and a cleaning fluid vapor filter which is inserted in the dryer vent stack pipe exhausting to the outside atmosphere.

The cleaning fluid dispenser serves to spray dispense a predetermined amount of cleaning fluid into the clothes dryer. Thereafter, the electronic controller of the dispenser actuates the rotation of the dryer drum and ventilation system for predetermined periods of time while the dryer housing is closed. The amount of fluid spray dispensed is programmed to correspond to the size of clothing load to be cleaned as determined by user actuation of a button on the dispenser housing best representing the estimated size of the load.

The cleaning fluid vapor filter serves to collect soil carried in the air and cleaning fluid vapor and precipitate the cleaning fluid during operation of the dryer and its ventilation system. The filter and dispenser are so designed to require disposal of the filter after a predetermined time of use. When this point is determined by a counter unit included in the central processing unit of the dispenser, the electronic controller automatically turns the dry cleaning machine off and the user is alerted through an indicator light that the soiled filter requires replacement. In this way the user is assured that only clean air is exhausted from the dryer's ventilation system.

The dispenser housing is mounted on the inner side of the dryer access door by means of magnetic catches or the like on the back side of the dispenser housing. The front side of the dispenser housing is provided with an access slot to receive a pressurized container of cleaning fluid which is retained within the dispenser housing by resilient flanges. The pressurized container is spring-biased against the inlet of the panel's spray dispensing nozzle. The outlet of the spray dispensing nozzle is located near the top of the front side of the dispenser housing to permit even coverage of the load to be cleaned with cleaning fluids The amount of cleaning fluid spray dispensed is monitored by the electronic controller after user selection of the cycle desired. Dispensing of cleaning fluid is initiated by pressing one of four selection buttons covering light (L), medium (M), heavy duty (HD), or extra heavy duty (EHD) loads. Pressing one of the selection buttons actuates a solenoid between the nozzle inlet an outlet so as to dispense the selected amount of cleaning fluid in the form of a spray. The level of concentration of the cleaning fluid in accordance with the selected cycle is further controlled by chemical concentration switches located on the dispenser housing to sense concentration of the cleaning fluid vapor in the dryer drum and near the filter. The four selection buttons are also located on the front side of the dispenser housing one of which must be actuated before the start button located adjacent to the cycle selection buttons will initiate operation of the dry cleaning machine. Actuating the start button converts the clothes dryer electrical system to the dry cleaning machine automatically as shown by an indicator light and starts operation after the access door of the dryer is closed and the door lock engaged. After completion of the dry cleaning cycle the machine automatically converts back to a home dryer.

Each of the four cycle selections and the electronic controller, control the amount of cleaning fluid spray dispensed, the amount of time the drum is rotated and the clothes tumbled and the amount of time thereafter that the dryer fan ventilates and exhausts vapor from the drum housing. In each cycle, the spray dispensing of cleaning fluid is programmed to end before commencement of drum rotation and tumbling.

The cleaning fluid vapor filter can only be used for a predetermined amount of operating time. When this point is reached the dry cleaning machine is automatically shut off by a counter unit in the electronic controller in the dispenser housing which also turns on an indicator light alerting the user to the need to change the filter. The dry cleaner cannot be restarted without first replacing the used filter with a new filter and pressing a button which will permit restarting when the replacement has been made.

To further prevent any leakage of vapor from the dryer unit, a special lock engages automatically with the starting of the dry cleaning cycles. Further, an adhesive sealer provided for location around the dryer access door assures closure of the access door against the dryer housing.

DETAILED DESCRIPTION OF THE PREFERRED EMBODIMENT OF THE INVENTION

Figure 1:
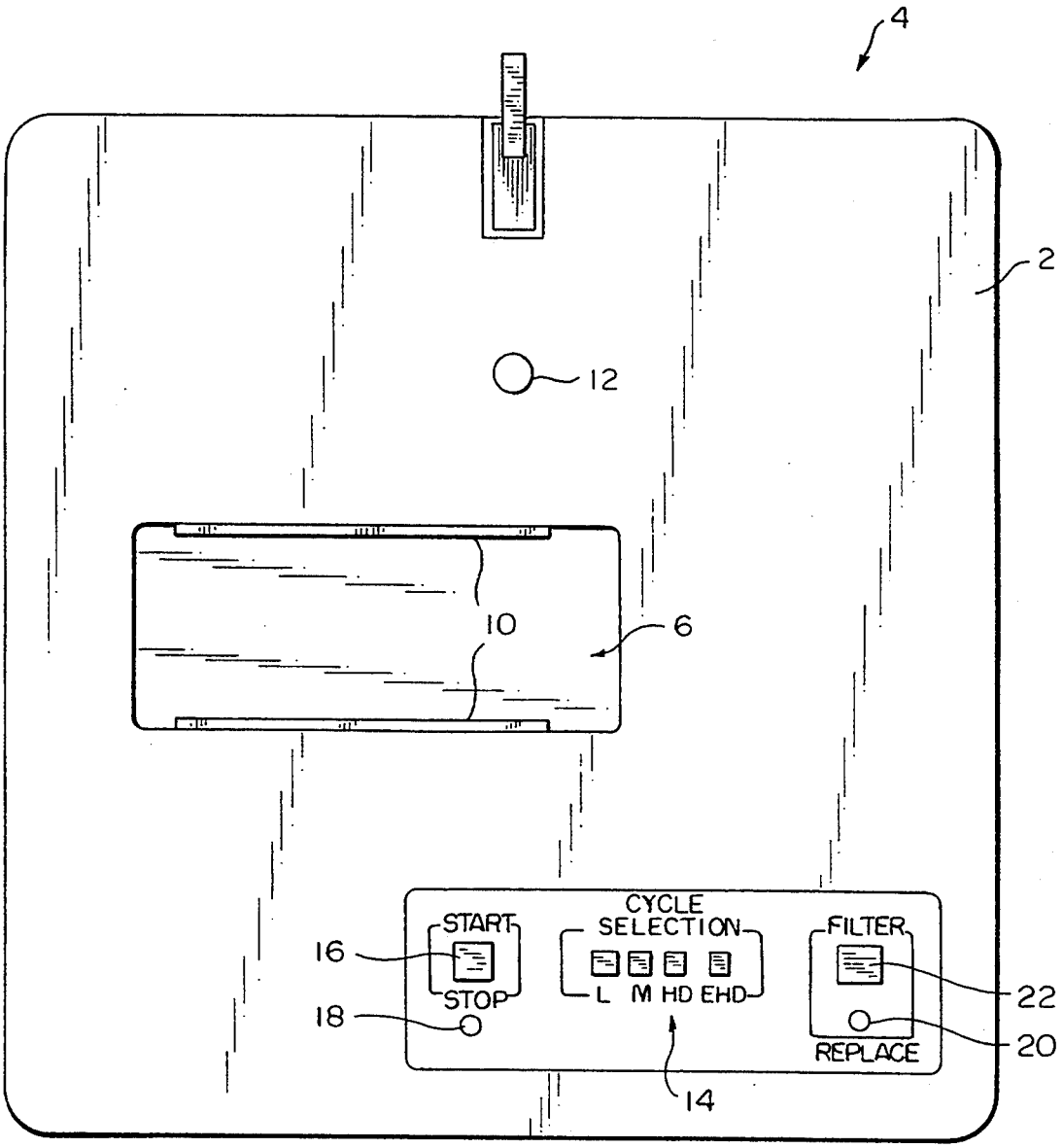
FIG. 1 is an elevation view of the front side of the cleaning fluid dispensing panel in accordance with the invention.
Figure 2:
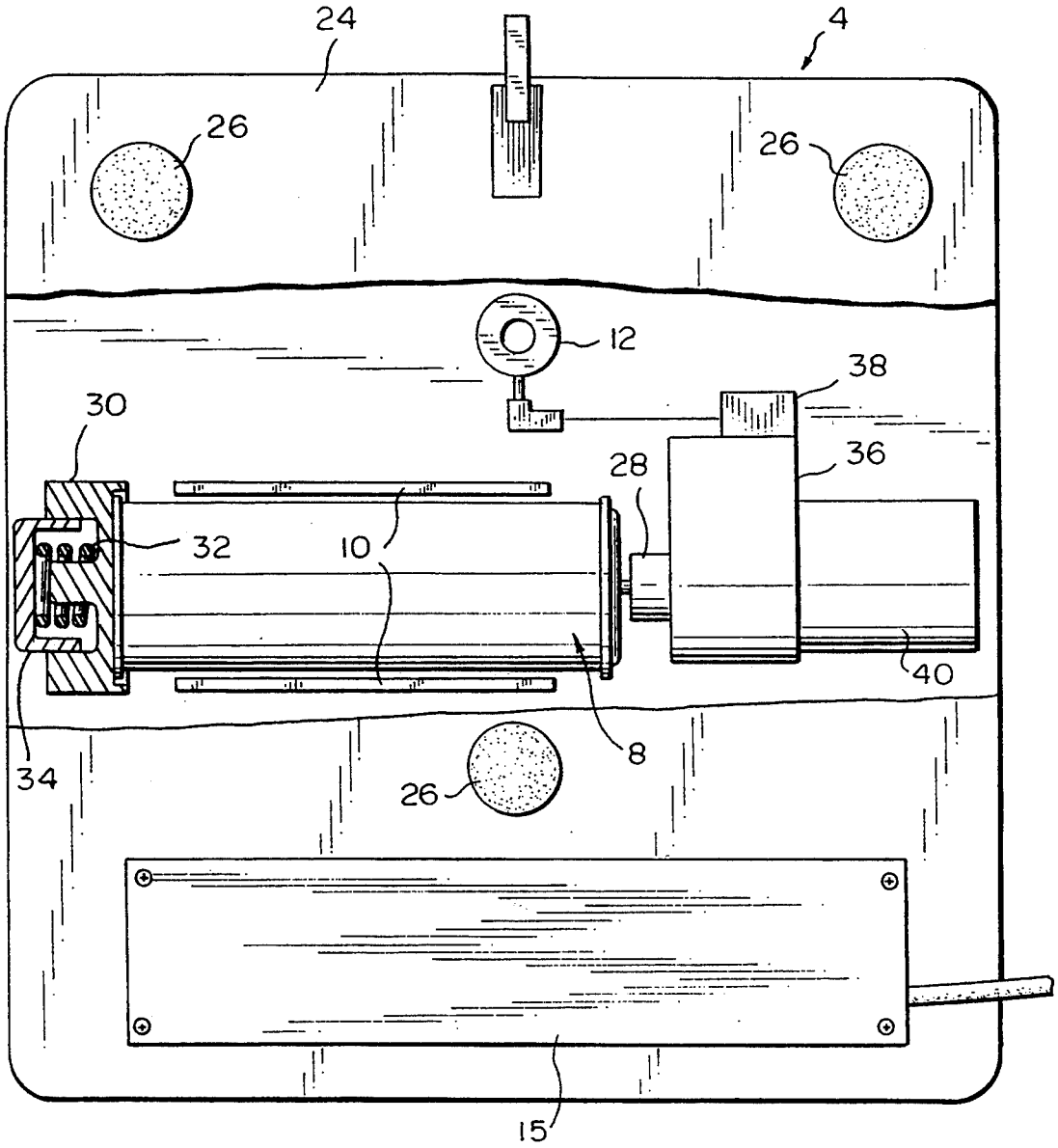
FIG. 2 is an elevation view of the back side of the cleaning fluid dispensing panel in accordance with the invention partially broken away to reveal internal components.

As shown in FIG. 1, a front side 2 of the cleaning fluid dispenser housing 4 has a slot 6 for insertion of a pressurized cleaning fluid container 8 (shown in FIG. 2). Resilient flanges 10 are provided in slot 6 for retaining container 8 in housing 4. Outlet nozzle 12 is shown on an upper portion of front side 2 to enable even spray dispensing of the cleaning fluid over clothing loads to be dry cleaned.

Selection panel 14 houses therein start/stop button 16 and start indicator light 18 showing whether button 16 has been turned on to initial operation. Selection panel 14 also houses therein cycle selection buttons L, M, HD, and EHD which represent respectively the buttons for choosing the cycles for cleaning a light, medium, heavy duty, or extra heavy duty load. Each cycle selection button L, M, HD and EHD is electronically programmed to control, 1) the amount of cleaning fluid input, 2) the length of time the dryer drum rotates, and 3) the duration of necessary time that the drum is ventilated to complete cleaning of the selected load.

Selection panel 14 also houses replacement filter indicator light 20 which when lit indicates that the dry cleaner cannot be operated until the cleaning fluid vapor filter 42 is replaced by a new filter. Filter start button 22 permits restarting the dry cleaner after filter 42 has been replaced.

The back side 24 of housing 4 is shown in FIG. 2. Magnetic catches 26 are provided to permit detachable engagement of housing 4 to the back side of an access door of a conventional clothes dryer. Container 8 is shown engaged to resilient flanges 10 and spring-biased against nozzle inlet 38 by base member 20 slidably engaged over U-shaped holder 34 fixed to back side 24. Base member 30 is urged against the bottom of container 8 by spring 32 engaged between base member 30 and U-shaped holder 34.

Container 8 dispenses cleaning fluid through nozzle inlet 28 into cleaning fluid mixing and confinement chamber 36 through manifold 38 and to spray outlet nozzle 12, when solenoid 40 is actuated by selection of one of the four selection buttons L, M, HD, EHD and start button 16 all of which are respectively controlled by electronic controller 76 and central processing unit (CPU) 75. The level of concentration of the cleaning fluid in accordance with the selected cycle is further controlled by chemical concentration switches 78 and 80 (FIG. 4) located on the dispenser housing 4 to sense concentration of the cleaning fluid vapor in the dryer drum and near the filter 42.

Access door 15 shown on back side 24, permits access to electronic controller 76 and central processing unit 75 both of which are within selection panel 14.

To prevent leakage of chemicals from the machine while in operation a special lock 9 is provided which engages automatically whenever the machine is started. In addition to better assure against leakage, a self adhesive sealer (not shown) can be provided as part of the accessory kit for use around the periphery of the dryer drum door to seal the door against the housing of the clothes dryer.

Figure 3:
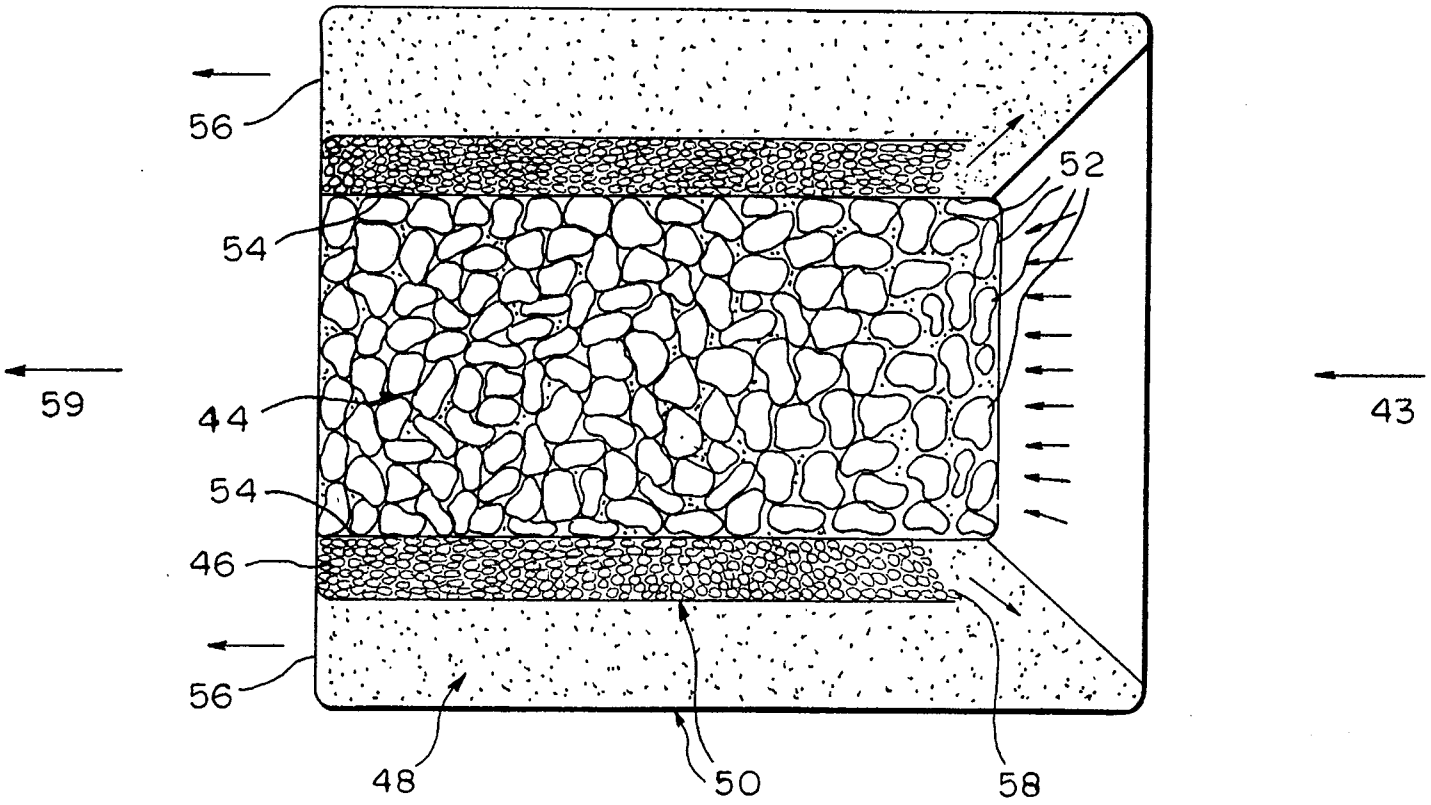
FIG. 3 is a cross-section through the cleaning fluid filter in accordance with the invention.

FIG. 3 of the drawings shows a cross-section through the cylindrical cleaning fluid vapor filter 42 used in combination with the cleaning fluid dispenser panel 4 to complete the accessory kit for converting a home clothes dryer to a dry cleaning machine in accordance with the invention.

At the time dispenser panel 4 is engaged to the inside of the dryer drum door of the home clothes dryer, filter 42 is placed inside the dryer's ventilation stack preferably near the dryer to limit the length of the run of the exhausted cleaning vapor and air. The diameter of the filter 42 is approximately 4 inches so as to entirely occupy the cross-section at the point it is placed in a conventional four inch home clothes dryer ventilation pipe, it being understood that the diameter of the filter may vary depending on the size of the ventilation pipe being used.

As shown in FIG. 3 cylindrical filter 42 comprises three cylindrical chambers 44, 46 and 48.

The three chambers are substantially closed and are defined by impermeable paper walls or covers 50 with inlet/outlet holes 52, 54 and 56 and outlet 58 therein to permit communication and passage of cleaning fluid vapor and air exhausted from the drum of the clothes dryer through the filter. The direction of the exhausted air and cleaning fluid vapor into filter 42 is shown by arrow 43. The unnumbered arrows shown in FIG. 3 indicate the direction of vapor and air flow through inlet/outlet holes 52, 54 and 56, outlet 58 and chambers 44, 46 and 48 of filter 42.

Chamber 44 is filled with activated wood charcoal, or the like, which first removes grease, oils and other soils carried in the exhausted cleaning fluid vapor after it passes into chamber 44 through holes 52. After passing through chamber 44, the charcoal-filtered exhaust exits through holes 54 into chamber 46.

Chamber 46 is filled with a chemical, of a known class preferably in solid form, which will react with a conventional cleaning fluid to deactivate and precipitate it in the chamber. After passing through chamber 46 the exhausted air scrubbed clean of cleaning fluid exits through outlet 58 into chamber 48.

Chamber 48 is filled with sand particles of varying size, or the like, which act as a fine and final filter for removal of any residual contaminates carried by the exhaust which thereafter exits through holes 56 as clean air in the direction shown by arrow 59.

Filter 42 has a limited operational life which is monitored by a counter device included in central processing unit 75. When the counter determines that the useful life of the filter is over, CPU 75 automatically turns the dry cleaning machine off and turns replacement filter indicator light 20 on. The machine cannot be restarted until the soiled filter 42 is removed and replaced by a new filter 42 which then permits restarting and the turning off of indicator light 20.

Figure 4:
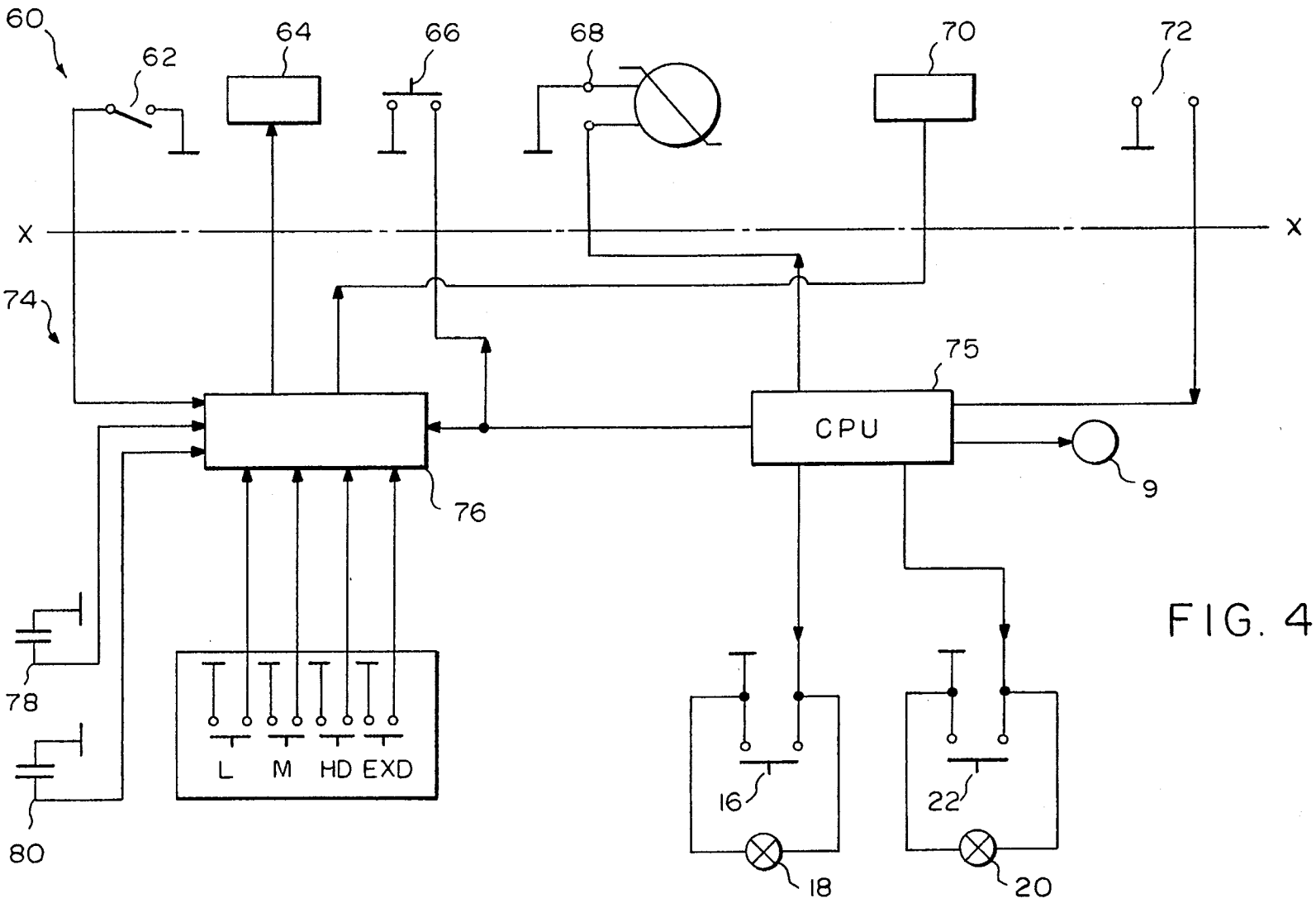
FIG. 4 is circuit diagram showing the circuitry of the dispenser connected to that of a conventional home dryer in accordance with the invention.

In order to activate the accessory kit in accordance with the invention the electrical system of the dispenser panel 4 is engaged to the existing electrical system of the conventional home clothes dryer to be converted to a dry cleaning machine. FIG. 4 of the drawings, shows a schematic of the engagement of the two electrical systems, with the schematic 60 of a conventional home clothes dryer shown above line x—x and the schematic 74 of the dispenser panel shown below line x—x.

Schematic 60 of the conventional home clothes dryer consists of door open/close switch 62, a dryer vent relay 64, a dryer stop/start button 66, a dryer vent control 68, a dryer electronic controller 70, and a dryer power supply 72.

Schematic 74 of the dispense panel 4 consists of cycle selection buttons L, M, HD and EHD, start/stop button 16, start indicator light 18, replacement filter indicator light 20, filter start button 22, the central process unit 75, main electronic controller 76, drum chemical concentration switch 78, filter chemical concentration switch 80 and special lock 9 which is included to prevent leakage of cleaning fluid from the dry cleaning machine while in operation.

FIG. 4 shows that actuation of start/stop button 16 enables control over the operation of the home dryer and the components of dispenser panel 4 through CPU 75 and electronic controller 76.

What is claimed is:

1. An accessory kit for converting a home dryer into a dry cleaning machine, said home dryer having a rotatable drum enclosed in a dryer housing sealable by a door, said dryer housing having a ventilation system vented to an atmosphere and associated electromechanical means for actuating rotation of said drum and said ventilation system, said accessory kit comprising:

cleaning fluid dispenser means detachably engaged to said door and said electro-mechanical means for spray dispensing a predetermined amount of cleaning fluid vapor into said drum and respectively actuating both rotation of said drum and said ventilation system for predetermined periods of time, and filter means engaged in an outlet of said ventilation system for separating soil from a mixture of air and soiled cleaning fluid vapor vented from said dryer housing and thereafter precipitating remaining cleaning fluid vapor from said air during exhaustion of said air through said filter wherein said cleaning fluid dispenser means comprises:

a dispenser housing having access means on a front side for receiving and retaining a pressurized container of cleaning fluid within said dispenser housing, a spray nozzle means on said dispenser housing for vaporizing said cleaning fluid and dispensing a cleaning fluid vapor on clothes in said rotatable drum, attachment means on said dispenser housing for engaging said dispenser housing to a back side of said door, an electronic controller means engaged in said dispenser housing for controlling operation of spray dispensing of a predetermined amount of said cleaning fluid vapor and rotation of said drum and said ventilation system for predetermined periods of time, and a central processor unit engaged in said dispenser housing for actuating operation of said spray dispensing, said rotation and said ventilation system.

2. The accessory kit of claim 1, wherein said cleaning fluid dispenser further comprises load selection means controlled by said electronic controller means on said dispenser housing for selection of different amounts of cleaning fluid for spray dispensing and different periods of time for rotation of said drum and operation of said ventilation system depending on a size of a clothing load to be cleaned.

3. The accessory kit of claim 1, wherein said filter means comprises:

a plurality of chambers.

4. The accessory kit of claim 3, wherein said plurality of chambers are arranged concentrically.

5. The accessory kit of claim 4, wherein each of said plurality of chambers is filled with a different material for removal of said soil and precipitating said cleaning fluid vapor.

6. The accessory kit of claim 1, wherein said filter comprises:

a first cylindrical chamber having a plurality of first inlets and a plurality of first outlets, said first cylindrical chamber filled with activated charcoal between said plurality of first inlets and said plurality of first outlets, a second cylindrical chamber concentric to said first cylindrical chamber and having a plurality of second inlets common to said plurality of first outlets and a second outlet, said second cylindrical chamber filled with chemical means for precipitating cleaning fluid vapor between said plurality of second inlets and said second outlet.

a third cylindrical chamber concentric to said first cylindrical chamber and said second cylindrical chamber having a third inlet common to said second outlet and a plurality of third outlets, said third cylindrical chamber filled with sand between said third inlet and said plurality of third outlets, wherein, air and soiled cleaning fluid vapor exhausted from said ventilation system enters said first cylindrical chamber and is scrubbed of soil by said charcoal and thereafter scrubbed air and cleaning fluid vapor enters said second cylindrical chamber where said cleaning fluid vapor is precipitated and thereafter remaining air enters said third cylindrical chamber for a final scrubbing before being exhausted from said third cylindrical chamber through said third outlets.

7. The accessory kit of claim 1, wherein said central processor unit has counter means for determining an operative time of said filter and actuating shut-off of said dispenser means when said operative time reaches a predetermined useful life of said filter.

8. The accessory kit of claim 7, wherein said counter means further actuates a replacement indicator light on said dispenser housing when said operative time reaches a predetermined useful life of said filter.

9. The accessory kit of claim 1, wherein said attachment means are magnetic catches.

10. The accessory kit of claim 1, wherein automatic lock means are located on said dispenser housing to engage said dryer housing in a manner to preclude opening said door when said cleaning fluid dispenser means is operating.

* * * * *